US009945060B2

(12) United States Patent
Chanda et al.

(10) Patent No.: US 9,945,060 B2
(45) Date of Patent: Apr. 17, 2018

(54) METHOD TO DETERMINE FABRIC TYPE IN A LAUNDRY TREATING APPLIANCE USING MOTOR CURRENT SIGNATURE DURING AGITATION

(75) Inventors: Hirak Chanda, Troy, MI (US); Kaustav Ghosh, Benton Harbor, MI (US); Andrew J. Leitert, Eau Claire, MI (US); Karl David Mcallister, Stevensville, MI (US); Amy L. Rapson, Holland, MI (US); Jon D. Strait, Saint Joseph, MI (US); Yingqin Yuan, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1349 days.

(21) Appl. No.: 13/353,347

(22) Filed: Jan. 19, 2012

(65) Prior Publication Data

US 2013/0185872 A1 Jul. 25, 2013

(51) Int. Cl.
*D06F 13/06* (2006.01)
*D06F 39/00* (2006.01)

(52) U.S. Cl.
CPC ..... *D06F 13/06* (2013.01); *D06F 39/003* (2013.01)

(58) Field of Classification Search
CPC ..... D06F 13/06; D06F 39/003
USPC ..... 8/137
See application file for complete search history.

(56) References Cited

U.S. PATENT DOCUMENTS

| | | | |
|---|---|---|---|
| 4,235,085 | A | 11/1980 | Torita |
| 4,553,413 | A | 11/1985 | Genji et al. |
| 4,607,408 | A | 8/1986 | Didier et al. |
| 5,144,819 | A | 9/1992 | Hiyama et al. |
| 5,161,393 | A | 11/1992 | Payne et al. |
| 5,233,847 | A | 8/1993 | Tanaka |
| 5,669,095 | A | 9/1997 | Dausch et al. |
| 5,897,672 | A | 4/1999 | Badami et al. |
| 6,151,742 | A | 11/2000 | Dausch et al. |
| 6,819,255 | B2 | 11/2004 | Chernetski |
| 6,842,928 | B2 | 1/2005 | Yang et al. |
| 7,047,583 | B2 | 5/2006 | Kim et al. |
| 7,484,258 | B2 | 2/2009 | Kim et al. |
| 7,950,086 | B2 | 5/2011 | Ashrafzadeh et al. |
| 2006/0021392 | A1 | 2/2006 | Hosoito et al. |
| 2009/0112513 | A1* | 4/2009 | Filippa et al. ..... 702/175 |
| 2010/0031451 | A1 | 2/2010 | Bae et al. |
| 2010/0102076 | A1* | 4/2010 | Hendrickson et al. ..... 221/9 |
| 2011/0005339 | A1 | 1/2011 | Ashrafzadeh et al. |
| 2011/0191964 | A1 | 8/2011 | Ashrafzadeh et al. |

FOREIGN PATENT DOCUMENTS

| | | | |
|---|---|---|---|
| DE | 3436786 | A1 | 4/1986 |
| DE | 69422162 | T2 | 4/2000 |
| DE | 19849403 | A1 | 5/2000 |
| EP | 0159202 | * | 10/1985 |
| EP | 0159202 | B1 | 10/1985 |
| EP | 0345120 | A1 | 12/1989 |
| WO | 2008026942 | A1 | 3/2008 |
| WO | WO 2008/026942 | * | 3/2008 |
| WO | 2011025339 | A1 | 3/2011 |
| WO | WO 2011/025339 | * | 3/2011 |

OTHER PUBLICATIONS

German Search Report for counterpart DE102012111147, dated Aug. 5, 2013.

* cited by examiner

*Primary Examiner* — Amina S Khan

(57) ABSTRACT

Disclosed is a method of operating a laundry treating appliance having a treating chamber that receives a laundry load for treatment according to a cycle of operation. The method includes determining the size of the laundry load in the treating chamber; supplying a predetermined amount of liquid to the treating chamber based on the determined load size; applying mechanical energy to the laundry treating chamber by driving a clothes mover with an electric motor; determining a difference between an in-rush current to the electric motor and a steady-state current of the electric motor during the applying of the mechanical energy; and determining a laundry load type of the laundry load based on the determined difference.

13 Claims, 4 Drawing Sheets

METHOD TO DETERMINE FABRIC TYPE IN A LAUNDRY TREATING APPLIANCE USING MOTOR CURRENT SIGNATURE DURING AGITATION

BACKGROUND OF THE INVENTION

Laundry treating appliances, such as clothes washers, clothes dryers, refreshers, and non-aqueous systems, may have a configuration based on a rotating drum that defines a treating chamber in which laundry items are placed for treating. The laundry treating appliance may also have a controller that implements a number of pre-programmed cycles of operation. Optimizing these cycles of operation while minimizing water and energy utilization is increasingly important. To achieve this balance between cycle optimization and water and energy minimization, it is important not only to know the mass of a laundry load, but also the type of fabric or garments in the drum. Known appliances can detect the laundry load mass using "dry" load sensing, but cannot reliably detect different "types" of fabric or garments without utilizing expensive sensors or increasing the cycle time.

BRIEF DESCRIPTION OF THE INVENTION

In one aspect, the invention is a method of operating a laundry treating appliance having a treating chamber that receives a laundry load for treatment according to a cycle of operation. The method includes determining the size of the laundry load in the treating chamber; supplying a predetermined amount of liquid to the treating chamber based on the determined load size; applying mechanical energy to the laundry treating chamber by driving a clothes mover with an electric motor; determining a difference between an in-rush current to the electric motor and a steady-state current of the electric motor during the applying of the mechanical energy; and determining a laundry load type of the laundry load based on the determined difference.

In another aspect, the invention is a laundry treating appliance configured to treat a laundry load according to at least one cycle of operation. The laundry treating appliance includes a treating chamber that receives a laundry load for treatment according to the cycle of operation; a controllable liquid supply providing liquid to the treating chamber; a laundry load sensor determining the amount of the laundry load in the treating chamber; a mechanical energy element providing mechanical energy to laundry load; an electric motor driving the mechanical energy element; a current sensor determining the current supplied to the electric motor; and a controller operably coupled with the controllable liquid supply, laundry load sensor, electric motor, and current sensor. The controller may control the controllable liquid supply to supply a predetermined amount of liquid to the treating chamber based on the determined load size; operate the electric motor to drive the mechanical energy element to apply mechanical energy to the laundry treating chamber; determine a difference between an in-rush current to the electric motor and a steady-state current of the electric motor during the applying of the mechanical energy; and determine a laundry load type of the laundry load based on the determined difference.

DESCRIPTION OF AN EMBODIMENT OF THE INVENTION

Figure 1:
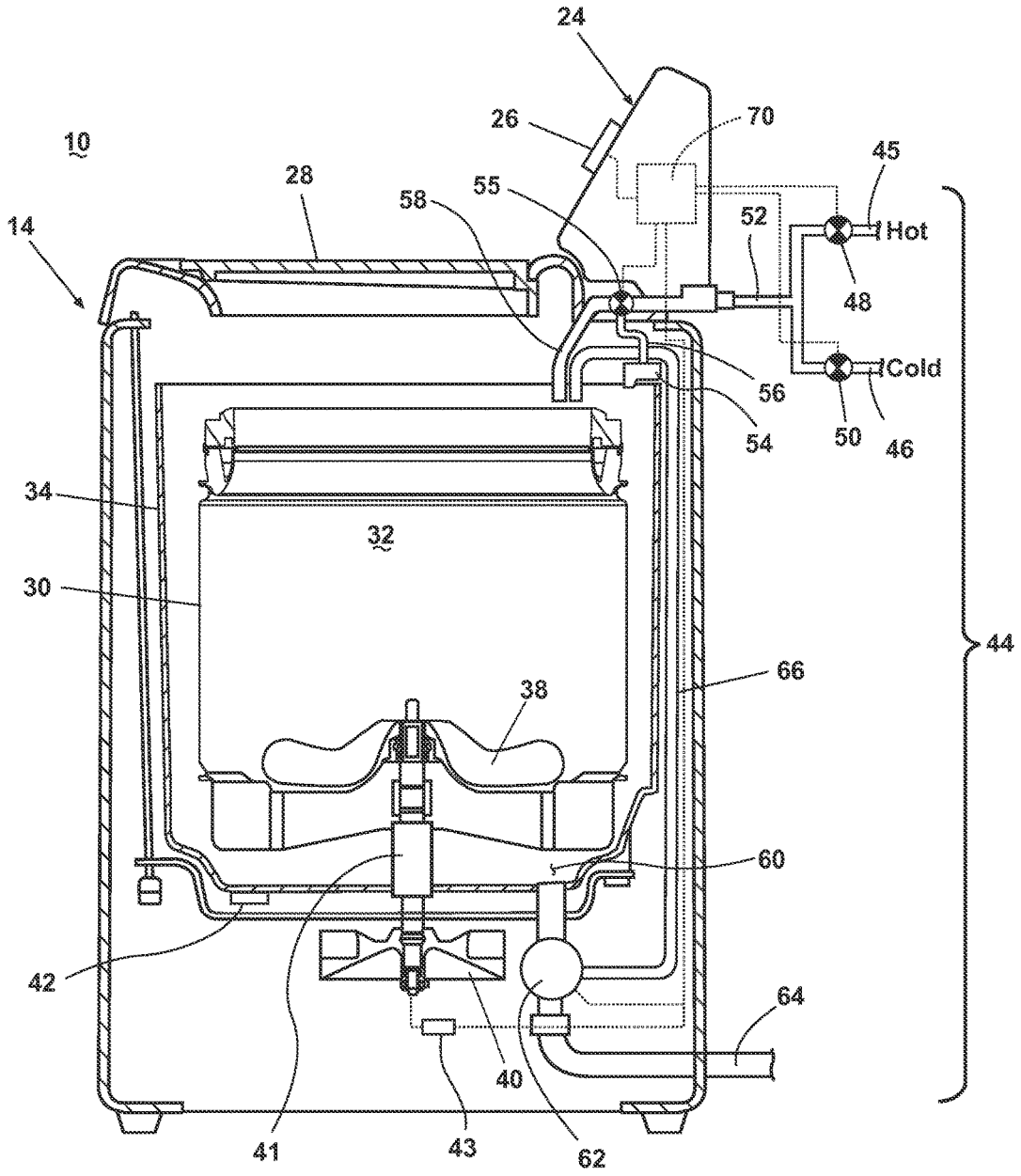
FIG. 1 is a vertical sectional view of a laundry treating appliance according to an exemplary embodiment of the invention.

As illustrated in FIG. 1, an exemplary embodiment of a laundry treating appliance 10 according to the invention may include a cabinet 14 with a control panel 24 attached thereto and having a user interface 26, which a user may utilize to operate the laundry treating appliance 10 through the steps of a wash cycle. An internal chassis (not shown) may be included, with the cabinet 14 mounted to the chassis.

A top wall of the cabinet 14 may have an openable door or lid 28, and may be selectively moveable between opened and closed positions to open and close an opening in the top wall, which may provide access to the interior of the cabinet 14. A rotatable drum 30 defining a treating chamber 32 for treating laundry may be positioned within an imperforate tub 34 having a sump 60, both of which may be disposed within the interior of the cabinet 14. The drum 30 may include a plurality of perforations (not shown), so that liquid may flow between the tub 34 and the drum 30 through the perforations. A clothes mover 38 may be located in the drum 30 to impart mechanical energy or agitation to a laundry load placed in the drum 30. The clothes mover can be any type of clothes mover, including one or a combination of an agitator, impeller, and auger, for example.

The drum 30 and/or the clothes mover 38 may be driven by an electric motor 40 operably coupled with the drum 30 and/or the clothes mover 38 through a clutch assembly 41. The motor 40 may be a brushless permanent magnet (BPM) motor. Other motors, such as an induction motor or a permanent split capacitor (PSC) motor may also be used. The clothes mover 38 may be oscillated or rotated about its axis of rotation during a cycle of operation in order to produce liquid turbulence effective to wash the load contained within the treating chamber 32. The motor 40 may rotate the drum 30 at various speeds in either rotational direction.

The tub 34 may include a load sensor attached thereto, and the motor 40 may be provided with an electric current sensor 43, both electrically coupled with a controller 70 located behind the control panel 24. A liquid supply and recirculation system 44 may be provided to spray treating liquid, such as water or a combination of water and one or more wash aids, into the open top of the drum 30 and onto a laundry load placed within the treating chamber 32. The liquid supply and recirculation system 44 may include a hot water inlet 45, a cold water inlet 46, hot and cold water valves 48, 50, an inflow conduit 52, a detergent dispenser 54, a diverter valve 55, and $1^{st}$ and $2^{nd}$ fill conduits 56, 58. The liquid supply and recirculation system 44 may be configured to spray treating liquid onto the fabric load directly from the hot and cold water inlets 45, 46 through the $2^{nd}$ fill conduit 58, or from the detergent dispenser 54 through the 1st fill conduit 56, and may be configured to recirculate treating liquid from the tub 34 and sump 60 to the drum 30. A pump 62 may be housed below the tub 34. The pump 62 may have an inlet fluidly coupled to the sump 60 and an outlet fluidly coupled to either or both a household drain 64 or a recirculation conduit 66.

Figure 2:
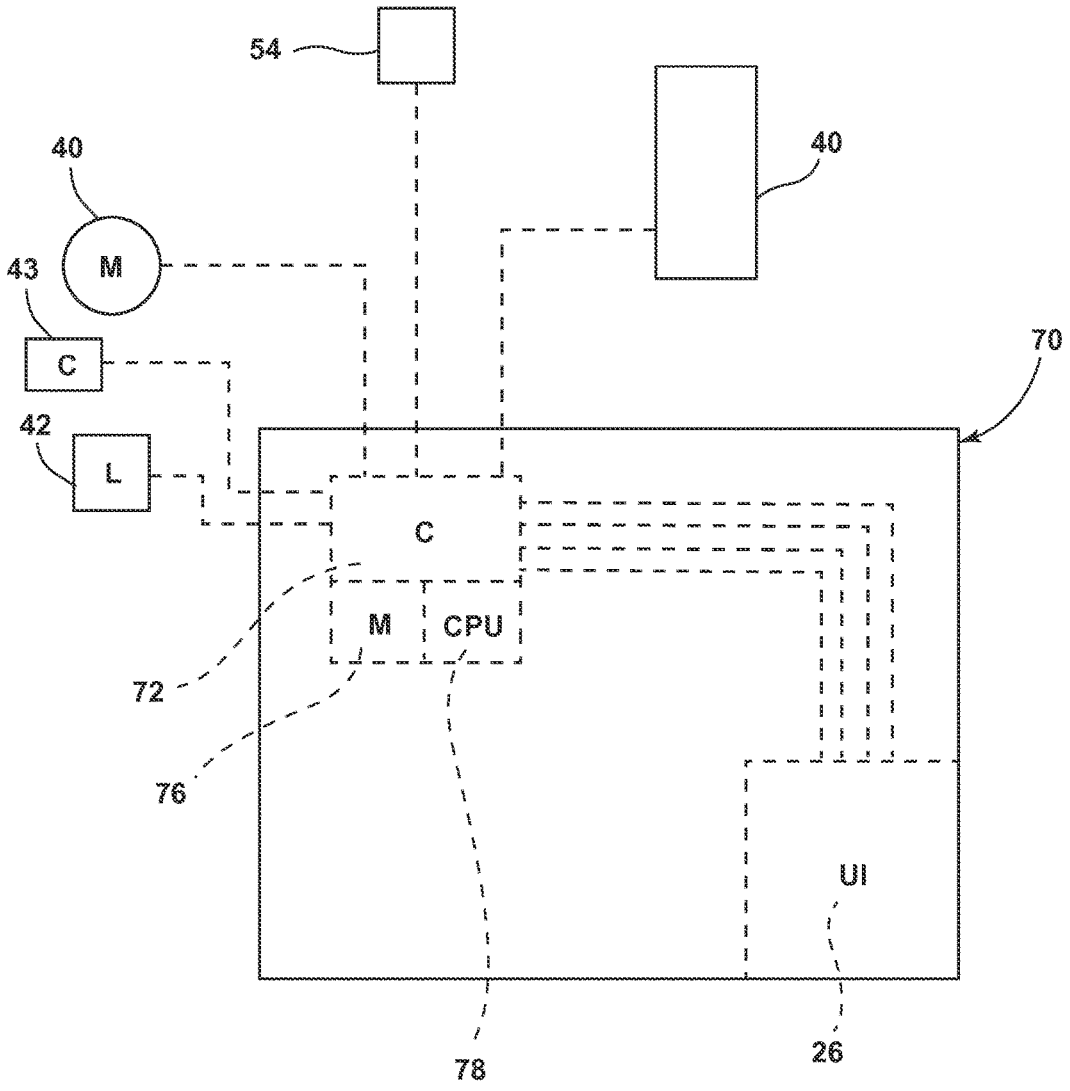
FIG. 2 is a schematic view of a control system illustrated in FIG. 1.

Turning now to FIG. 2, the control system 70 may control the operation of the laundry treating appliance 10 to implement one or more cycles of operation. The control system 70 may include a controller 72 located within the cabinet 14 and the user interface 26 that is operably coupled with the controller 72. The user interface 26 may include one or more knobs, dials, switches, displays, touch screens and the like for communicating with the user, such as to receive input and provide output. The user may enter different types of information including, without limitation, cycle selections and cycle options. The controller 72 may control the operation of the laundry treating appliance 10 utilizing a selected motor-control process, such as a closed loop speed control process.

The controller 72 may receive data from one or more working components and may provide commands, which may be based on the received data, to one or more working components to execute a desired operation of the laundry treating appliance 10. The commands may be data and/or an electrical signal without data. The user interface 26 may be coupled to the controller 72 and may provide for input or output to or from the controller 72. In other words, the user interface 26 may allow a user to enter input related to the operation of the laundry treating appliance 10, such as selection and/or modification of an operation cycle of the laundry treating appliance 10, and receive output related to the operation of the laundry treating appliance 10.

The controller 72 may be provided with a memory 76 and a central processing unit (CPU) 78. The memory 76 may be used for storing the control software that is executed by the CPU 78 in completing a cycle of operation using the laundry treating appliance 10 and any additional software. The memory 76 may also be used to store information, such as a database or table, and to store data received from one or more components of the laundry treating appliance 10 that may be communicably coupled with the controller 72. The database or table may be used to store the various operating parameters for the one or more cycles of operation, including factory default values for the operating parameters and any adjustments to them by the control system or by user input.

The controller 72 may be operably coupled with one or more components of the laundry treating appliance 10 for communicating with and controlling the operation of the components to complete a cycle of operation. For example, the controller 72 may be operably coupled with the detergent dispenser 54, the liquid supply and recirculation system 44, the motor 40, valves, diverter mechanisms, flow meters, and the like, to control the operation of these and other components to implement one or more of the cycles of operation.

One or more sensors and/or transducers, as known in the art, may be provided in one or more of the systems of the laundry treating appliance 10, and coupled with the controller 72, which may receive input from the sensors/transducers. Non-limiting examples of sensors that may be communicably coupled with the controller 72 include a treating chamber temperature sensor, a moisture sensor, the load sensor 42, a wash aid sensor, a position sensor, the motor current sensor 43, a motor torque sensor, and the like, which may be used to determine a variety of system and laundry characteristics.

The laundry treating appliance 10 may perform one or more manual or automatic treating cycles or cycle of operation and a common treating cycle includes a wash phase, a rinse phase, and a spin extraction phase. Other phases for treating cycles include, but are not limited to, intermediate extraction phases, such as between the wash and rinse phases, and a pre-wash phase preceding the wash phase, and some treating cycles include only a select one or more of these exemplary phases.

The method described hereinafter may detect the type of fabric or clothing (e.g. polyester vs. terrycloth) without the use of expensive sensors or an increase in cycle time. The mass of laundry in the treating chamber 32 may be estimated by use of the load sensor 43 or by a known inertia method. The estimated mass may be utilized to determine a volume of liquid to be utilized. A motor current signature may be utilized in conjunction with the mass of the load to determine the type of fabric or clothing comprising the load.

A motor spin mode may be used to estimate an inertia of the laundry load. Inertia may be determined from a determination of a selected operating characteristic, such as motor torque. After this is completed, liquid valves may be opened and a minimum volume of liquid may be introduced into the treating chamber 32 corresponding to an "extra light" cycle, e.g. "delicate" or "lingerie" and the estimated load mass. Absorbability of the laundry load may also be a factor in determining the minimum volume of liquid to be introduced. Agitation may begin during which the motor current may be monitored.

The cycles of operation may have an associated qualitative load type, such as delicate, very light, light, medium, heavy. These load types may also be selected as an option for a cycle without an associated load type. The qualitative load types, while grouped based on fabric type, also will have relationship to the absorbency of the material. For example, most delicates, like silks, have relatively low absorbency as compared to heavy fabric, such as cotton, which has a relatively high absorbency. The mixing of the different fabric types can lead to categorizing the entire load as delicate, very light, light, medium, and heavy based on the overall absorbency of the load. The loads may also be qualitatively grouped into sizes such as extra small, small, medium, large, extra large.

Figure 3:
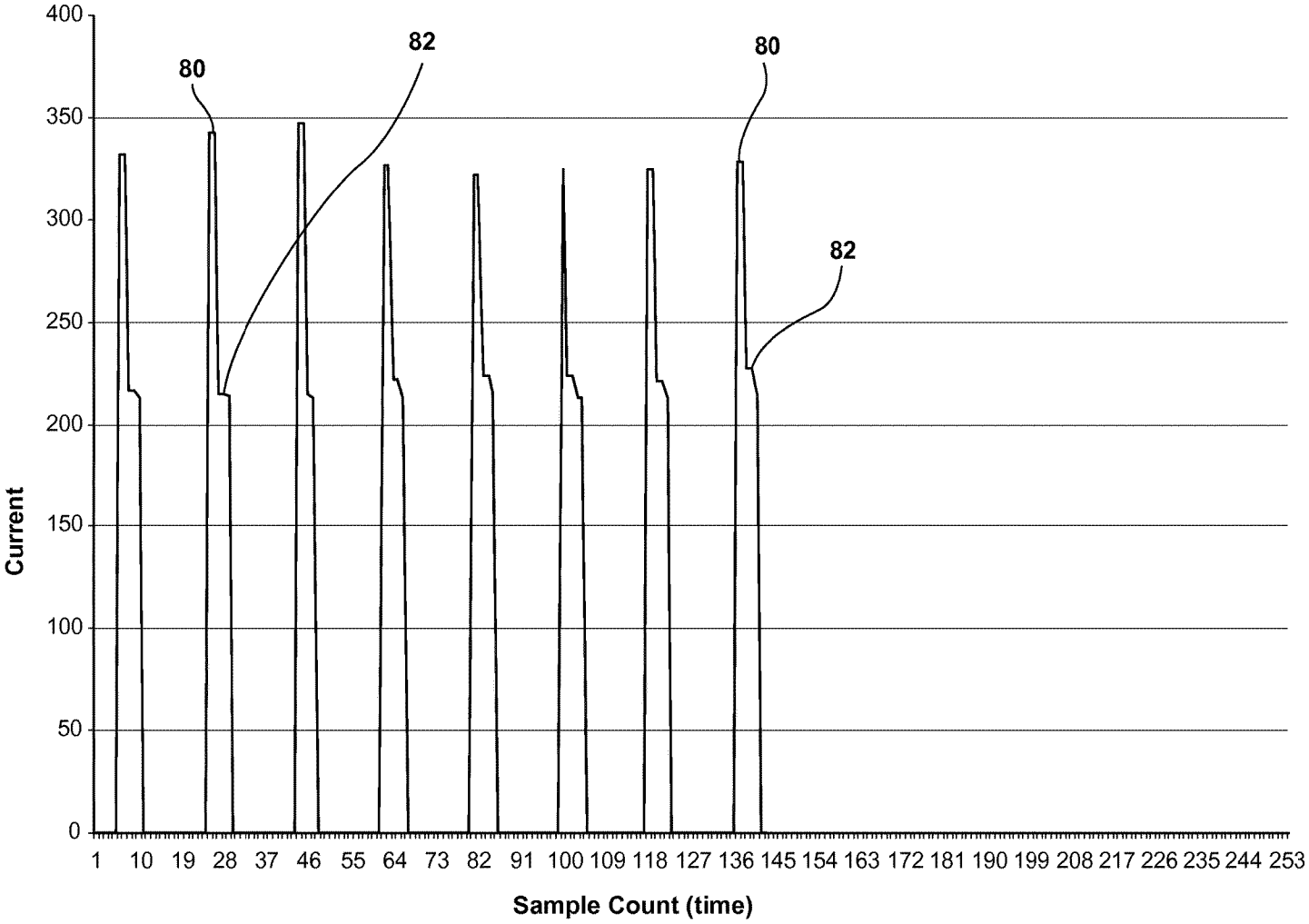
FIG. 3 is a graphical representation of a motor current profile illustrating motor torque sufficient to move a laundry load in a selected volume of treating liquid.

FIG. 3 illustrates a current profile for a typical PSC motor operating in an "extra light" cycle. During agitation, the initial motor current may be characterized by a relatively high spike 80 or "inrush current." This may be followed by a drop to a steady state current 82. A substantial drop, i.e. a substantial difference between the inrush current 80 and the steady state current 82, may be indicative of little resistance to agitation from the laundry load. Thus, the illustrated current profile, with the high spike 80 and lower steady-state current 82, may be indicative of sufficient liquid in the treating chamber 32 to enable agitation of the laundry load.

For the light load, the volume of liquid delivered to the treating chamber 32 may be sufficient to move the load, and the drop in current may be high. Initially, the delivery of liquid may make the load more buoyant, thereby facilitating movement of the load by the clothes mover 38. This may reduce the work load on the motor 40, which may result in a drop in motor current. However, as the volume of liquid is increased, the clothes mover 38 must begin moving the liquid in addition to the laundry load, which may increase the torque required to rotate the clothes mover. This may decrease the magnitude of the drop in motor current, i.e. the magnitude of the difference between the spike 80 and the steady state current 82. There may come a point when the torque reduction attributable to an increased buoyancy may be offset by an increased torque required to move the additional liquid. This may correspond to an optimal volume of liquid.

The drop in current may be compared to a threshold value of current ($Th_1$). It is anticipated that $Th_1$ may represent the largest drop in current that may be anticipated for a particular fabric type. For a heavy load, such as denim jeans or terrycloth towels, the drop in current may be compared to a different threshold value ($Th_2$). For mixed loads, the drop in current may be a value between $Th_1$ and $Th_2$.

Figure 4:
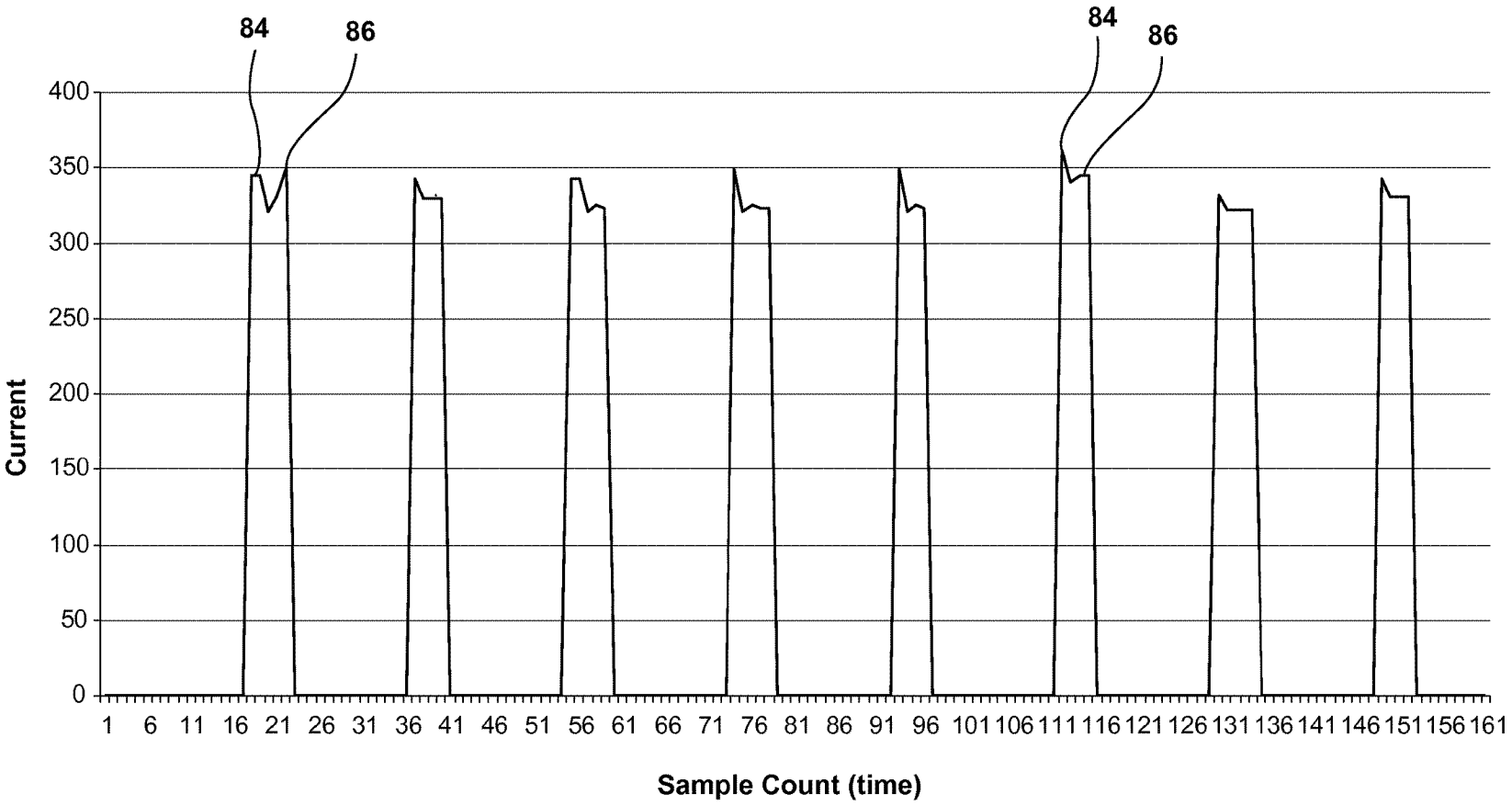
FIG. 4 is a graphical representation of a motor current profile illustrating motor torque insufficient to move a laundry load in a selected volume of treating liquid.

As illustrated in FIG. 4, if the motor torque is insufficient to overcome fabric resistance, which may occur with too little liquid or too heavy a load for a selected cycle of operation, e.g. selecting "delicate" for a laundry load consisting of towels, the difference between an inrush current 84 and a steady state current 86 may be minimal or even negative. Based on this information, a decision may be made concerning a) additional liquid to be added, b) selection of a different agitation profile, and c) additional spin time.

Threshold values $Th_1$, $Th_2$ may be established empirically for selected variables, such as cycle of operation, load weight/mass, load type, and the like. These values may be stored in memory 76 in a matrix or "lookup table" format that may be readily retrievable and utilized by the controller 72. In practice, a user may select a cycle of operation, the load weight/mass or volume may be determined in a generally known manner, and a volume of liquid may be delivered to the treating chamber 32. The clothes mover 38 may begin oscillating, and the motor current may be monitored. From the motor current, a difference between the inrush current and the steady state current may be established. This difference may be compared with threshold values in memory 76, and the results of the comparison may be used to determine the load type. The volume of liquid identified for the selected cycle, the laundry load size, and the load type may then be delivered to the treating chamber 32, and the cycle may progress.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for operating a laundry treating appliance having a treating chamber that receives a laundry load for treatment according to a cycle of operation, the method comprising:

determining the size of the laundry load in the treating chamber, supplying a predetermined amount of liquid to the treating chamber based on the determined load size;

applying mechanical energy to the laundry treating chamber after supplying the liquid to the treating chamber by driving a clothes mover with an electric motor;

determining a difference in electric current values between an initial electric current to the electric motor, and a steady-state electric current to the electric motor, during the applying of the mechanical energy; and determining a laundry load type of the laundry load based on the determined difference in electric current values.

2. The method of claim 1 wherein the load size is determined from a user input to the laundry treating appliance.

3. The method of claim 1 wherein the load size is determined by rotating the treating chamber with the electric motor and determining an operating characteristic of the motor that is indicative of the inertia of the laundry load.

4. The method of claim 3 wherein the operating characteristic is torque.

5. The method of claim 1 wherein the clothes mover comprises a rotatable drum defining the treating chamber.

6. The method of claim 1 wherein the clothes mover comprises an agitator located within the treating chamber.

7. The method of claim 1 wherein the determining the difference in electric current values comprises a controller receiving a current signal from a current sensor, where the current signal is indicative of the motor current and the controller determines the difference in electric current values.

8. The method of claim 1 wherein the determining a laundry load type comprises determining a qualitative laundry load type.

9. The method of claim 8 wherein the qualitative laundry load type comprises at least one of a light load and a heavy load.

10. The method of claim 9 wherein the light load is a relatively non-absorbent load and the heavy load is a relatively absorbent load.

11. The method of claim 1 further comprising supplying liquid to the treating chamber to provide a treating amount of liquid based on the laundry load type.

12. The method of claim 11 wherein the treating amount of liquid is determined by supplying liquid to the treating chamber while repeatedly determining the difference in electric current values until the determined difference satisfies a threshold.

13. The method of claim 12 wherein the threshold is a maximum difference in electric current values.

* * * * *